US010032349B1

(12) United States Patent
Kelsch et al.

(10) Patent No.: US 10,032,349 B1
(45) **Date of Patent: *Jul. 24, 2018**

(54) ANTI-THEFT DEVICE FOR MONITORING A UNIVERSAL SERIAL BUS TYPE C CONNECTOR

(71) Applicants: Christopher A. Kelsch, Palm Harbor, FL (US); Chung-Ping Lee, Taoyuan (TW); Vanguard Products Group, Inc., Oldsmar, FL (US)

(72) Inventors: Christopher A. Kelsch, Palm Harbor, FL (US); Chung-Ping Lee, Taoyuan (TW); John N. Figh, Jr., Oldsmar, FL (US); Lucas P. Swartwood, Tampa, FL (US); Bruno M. L. Telles, Tampa, FL (US); Ryan G. Bernosky, San Antonio, FL (US)

(73) Assignee: Vanguard Products Group, Inc., Oldsmar, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/795,939

(22) Filed: Oct. 27, 2017

Related U.S. Application Data

(63) Continuation of application No. 14/969,629, filed on Dec. 15, 2015, now Pat. No. 9,830,788.

(60) Provisional application No. 62/091,978, filed on Dec. 15, 2014.

(51) Int. Cl.

| | |
|---|---|
| ***G08B 13/14*** | (2006.01) |
| ***H01R 13/66*** | (2006.01) |
| ***H01R 24/62*** | (2011.01) |
| *H01R 103/00* | (2006.01) |

(52) U.S. Cl.
CPC ..... *G08B 13/1463* (2013.01); *H01R 13/6683* (2013.01); *H01R 24/62* (2013.01); *H01R 2103/00* (2013.01)

(58) Field of Classification Search
None
See application file for complete search history.

(56) References Cited

U.S. PATENT DOCUMENTS

| | | | |
|---|---|---|---|
| 5,699,591 | A | 12/1997 | Kane |
| 6,285,283 | B1 | 9/2001 | Rand et al. |
| 8,517,748 | B1 | 8/2013 | Kelsch et al. |
| 8,696,377 | B2 | 4/2014 | Kelsch et al. |

*Primary Examiner* — Brian Zimmerman
*Assistant Examiner* — Sara Samson
(74) *Attorney, Agent, or Firm* — Andriy Lytvyn; Smith & Hopen, P.A.

(57) ABSTRACT

An anti-theft device for monitoring Type C USB connector. An alarm module has a first terminal and a second terminal. A male plug has a first conductive member in electrical communication with the first terminal and a second conductive member in electrical communication with the second terminal. When the male plug is positioned within the receptacle, a closed electric circuit forms between the first and second conductive members. The alarm module supplies an electric current to the first terminal and monitors the electric current flowing to the second terminal. Responsive to detecting an interruption in the electric current flowing between the first and the second terminals, the alarm module transmits an alarm signal.

8 Claims, 6 Drawing Sheets

ANTI-THEFT DEVICE FOR MONITORING A UNIVERSAL SERIAL BUS TYPE C CONNECTOR

PRIORITY CLAIM

This patent application claims priority to a U.S. Non-Provisional application Ser. No. 14/969,629 filed Dec. 15, 2015 entitled "Security Monitoring Device for a Universal Serial Bus Type C Connector," which claims priority to U.S. Provisional Patent Application Ser. No. 62/091,978 filed Dec. 15, 2014 having the same title, which is incorporated herein by reference.

BACKGROUND OF THE INVENTION

1. Field of the Invention

This invention relates to merchandise anti-theft devices. More specifically, it relates to an anti-theft device intended for monitoring the connection between a male plug and receptacle of a Type C universal serial bus ("USB").

2. Brief Description of the Related Art

Retailers often prefer to present their merchandise to consumers in a way that allows the consumers to touch, inspect, and otherwise interact with the products at a display counter. Many merchandise items, especially portable electronic devices, are relatively expensive and, therefore, are under a serious threat of theft. Retailers often face a dilemma pertaining to how to interactively display their merchandise to attract customers and increase sales, while, at the same time, safeguarding the merchandise against theft.

A number of anti-theft devices are known in the art. Some anti-theft solutions involve various types of brackets that secure an electronic gadget to the display counter. Others involve protective sheaths and cases. What is needed, however, is an anti-theft device that discretely monitors the electronic gadget against unauthorized removal from the display counter without interfering with its aesthetic or functional features.

One such solution is disclosed in U.S. Pat. Nos. 8,517,748 and 8,696,377. The anti-theft device disclosed in those patents comprises a male USB plug that is inserted into a corresponding female USB, mini USB, or micro USB receptacle to supply electric current to the gadget. The male plug two conductive members electrically insulated from one another. When the male plug is within the receptacle, the inner conductive surface of the female USB receptacle contacts both conducive members, thereby closing an electric circuit between them. An alarm module is used to monitor this closed circuit and trigger an alarm when the circuit is broken.

The anti-theft device of the '748 and '377 Patents, however, cannot be used to monitor the connection between a male plug and a receptacle of a Type C USB connector due to significant changes in the connector's structural configuration. Accordingly, there is a need for a new anti-theft device for monitoring the connection between a male plug and a receptacle of a Type C USB connector without diminishing the functionality provided by the Type C USB connector.

SUMMARY OF THE INVENTION

In an embodiment, the invention is an anti-theft device for monitoring an electrical gadget having a female receptacle, such as a Type C universal serial bus (USB) female receptacle. The anti-theft device includes an alarm module. The alarm module has a first and second terminals. The alarm module further includes an electric circuitry residing therein configured to monitor electron flow between the first and second terminals. A male plug has an electrically conductive sheath and at least one electrically conductive latch disposed therein. When the male plug is inserted into the female receptacle the latch engages a lateral edge of the mid-plate establishing an electrical communication therewith.

In an embodiment, the male plug includes two latches residing within the sheath. The latches are configured to simultaneously contact the mid-plate of the female receptacle when the male plug is inserted therein. In an embodiment, distal ends of the first and second latches are distanced apart from one another by a distance less than a width of the mid-plate, whereby the mid-plate causes the latches to elastically deform when the male plug is inserted into the female receptacle. The mid-plate may further include notches configured to receive bends or protrusions at distal ends of the latches.

In an embodiment, the first latch is connected to a first terminal of the alarm module and a second latch is connected to the second terminal of the alarm module. When the male plug is inserted into the female receptacle, the mid-plate becomes an electrical conduit between the first and second latches thereby enabling electron flow between the first and second terminals of the alarm module. The alarm module supplies electric current to the first terminal and detects electric current flowing to the second terminal. The alarm module monitors the electron flow between its terminals and transmits an alarm signal responsive to detecting an interruption in the flow of the electric current between the first and second terminals.

In an alternative embodiment, both latches of the male plug are connected to the first terminal of the alarm module, and the sheath of the male plug is connected to the second terminal of the alarm module. In this embodiment, the electric current flows from the first terminal to the conductive latches which are in electrical communication with the mid-plate of the female receptacle. The mid-plate and the shell of the female receptacle are in electrical communication with one another, thereby enabling electric current to flow from mid-plate to the shell. The shell is in electrical communication with the sheath of the male plug, which is connected to the second terminal. The alarm module monitors the circuit described above and transmits an alarm signal responsive to interruption in the electron flow between the first and second terminals.

The latches do not form an electrical connection with the sheath. The anti-theft device may comprise an insulating material disposed on the latches or an inner surface of the sheath to insulate the latches from the sheath. Alternatively, the latches may be shaped such that they do not contact the sheath when the male plug is inserted into the female receptacle.

In an alternative embodiment, the latches are eliminated. Instead, a first conductive pin of the male plug is connected to the first terminal of the alarm module, and a second conductive pin is connected to the second terminal of the alarm module. When the male plug is inserted into the female receptacle, the conductive pins of the male plug engage ground electric contacts of the female receptacle. This configuration enables an electric current to flow between the conductive pins of male plug, thereby enabling an electric current to flow between the first and second terminals of the alarm module. The alarm module monitors the circuit described above and transmits an alarm signal responsive to interruption in the electron flow between the first and second terminals.

In yet another embodiment, at least one of the conductive pins of the male plug is connected to the first terminal of the alarm module, and the sheath is connected to the second terminal of the alarm module. The shell and the ground contacts of the female receptacle are in electrical communication with one another. Accordingly, when the male plug is inserted into the female receptacle, a closed circuit is formed between the terminals of the alarm module, wherein electric current flows from a conductive pin of the male plug to a ground contact of the female receptacle. The electric current flows from the ground contact to the shell of the female receptacle and then to the sheath of the male plug, which is connected to the second terminal of the alarm module. This configuration enables an electric current to flow between the first and second terminals of the alarm module. The alarm module monitors the circuit described above and transmits an alarm signal responsive to interruption in the electron flow between the first and second terminals.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1:
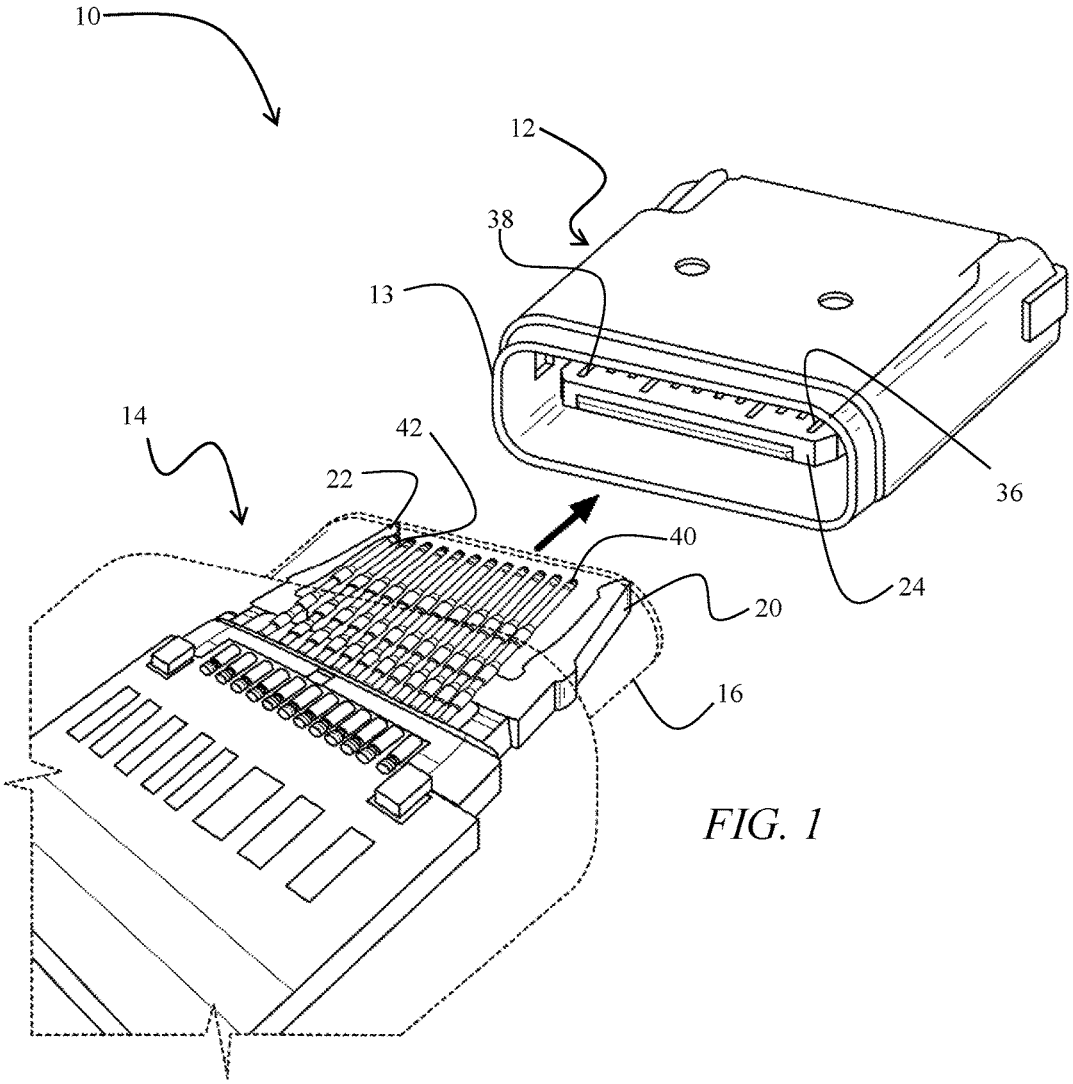
FIG. 1 is a perspective view of an embodiment of the anti-theft device depicting a male plug having two conductive latches being inserted into a corresponding Type C USB female receptacle.

FIG. 1 depicts an anti-theft device 10 for monitoring an electronic device having a Type C USB female receptacle 12. Anti-theft device 10 comprises a male plug 14 having an external conductive sheath 16 enclosing a plurality of contacts. Male plug 14 includes a first latch 20 and a second latch 22 residing within sheath 16. First and second latches 20 and 22 are made of an electrically conductive material. Receptacle 12 includes a conductive mid-plate 24 intended for grounding the electrical connection formed between plug 14 and receptacle 12.

Figure 2:
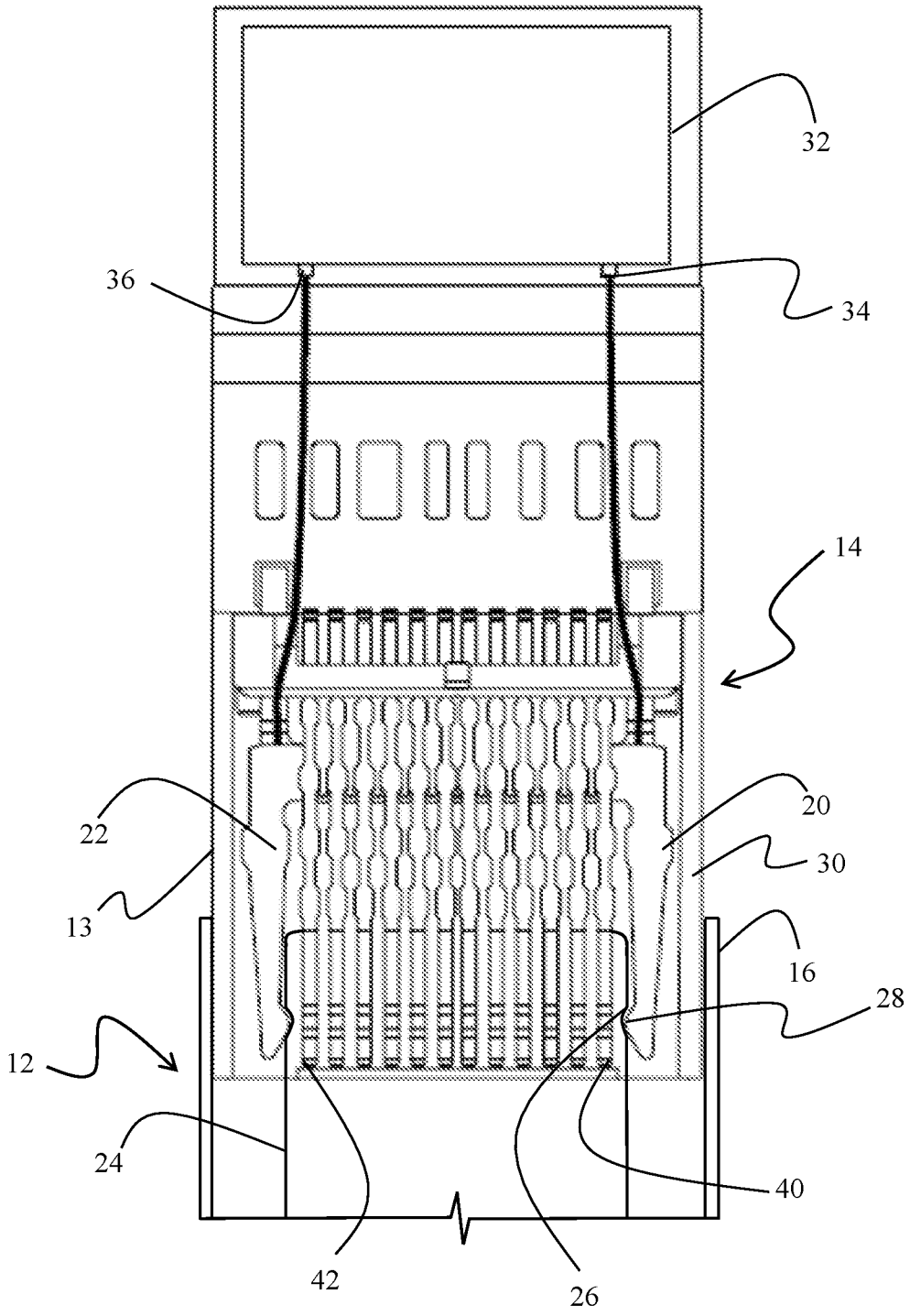
FIG. 2 is a top side view depicting the male plug of the anti-theft device residing within the female receptacle, wherein conductive latches of the male plug engage the mid-plate of the female receptacle.

The distal ends of first and second latches 20 and 22 are adapted to simultaneously contact mid-plate 24 of receptacle 12 when male plug 14 is inserted therein, as depicted in FIG. 2. As plug 14 is being inserted into receptacle 12, first and second latches 20 and 22 undergo elastic deformation as mid-plate 24 slides in between them. In response to being elastically deformed, first and second latches 20 and 22 exert opposite inwardly directed forces onto the opposite lateral edges of mid-plate 24. This configuration ensures that contact is maintained between first and second latches 20 and 22 and mid-plate 24 while plug 14 is within receptacle 12. This feature of anti-theft device 10 reduces the instances of false alarms due to movement of the plug within the receptacle while the consumers are interacting with the gadget being displayed. In an embodiment, mid-plate 24 contains notches 26 configured to receive bends or protrusions 28 positioned near the distal ends of first and second latches 20 and 22. This structural configuration further secures the connection between first and second latches 20 and 22 and mid-plate 24, thereby retaining plug 14 inside receptacle 12 to help prevent accidental removal.

Continuing reference to FIG. 2, anti-theft device 10 includes an alarm module 32 having a first terminal 34 and a second terminal 36. Alarm module 32 is configured to supply an electric current to first terminal 34. First latch 20 within plug 14 is in electrical communication with first terminal 34, and second latch 22 is in electrical communication with second terminal 36. When plug 14 is inserted into receptacle 12, the electric circuit between first and second terminals 34 and 36 of alarm module 32 is closed.

A circuitry is disposed within alarm module 32. The circuitry is in electrical communication with first and second terminals 34 and 36 of alarm module 32 and is used by alarm module 32 to detect disturbances in the electron flow between first and second terminals 34 and 36. Upon detection of an interruption of the electron flow, alarm module 32 transmits an alarm signal. The alarm signal is intended to alert the store staff about potential unauthorized activity or a theft attempt. The alarm signal may be audible, visual, or may be a communication to an appropriate party via any means known in the art, including an automated phone call, text message, or an email.

Sheath 16 of plug 14 is electrically conductive. Therefore, in the embodiment disclosed above, first and second latches 20 and 22 do not directly contact the inner surface of sheath 16. For this reason, an electrically insulating layer 30 may be disposed either on the inner surface of sheath 16 in locations where first and second latches 20 and 22 contact sheath 16, on first and second latches 20 and 22 themselves, or both. Insulating layer 30 ensures that electrically conductive sheath 16 of plug 14 does not interfere with an electric circuit formed by first and second latches 20 and 22 and mid-plate 24. In an alternative embodiment, the shape of first and second latches 20 and 22 is such that first and second latches 20 and 22 bend inwardly away from inner surface of sheath 16. This structural feature of first and second latches 20 and 22 eliminates the contact points between first and second latches 20 and 22 and sheath 16. In this embodiment, an insulating layer is superfluous.

Figure 3:
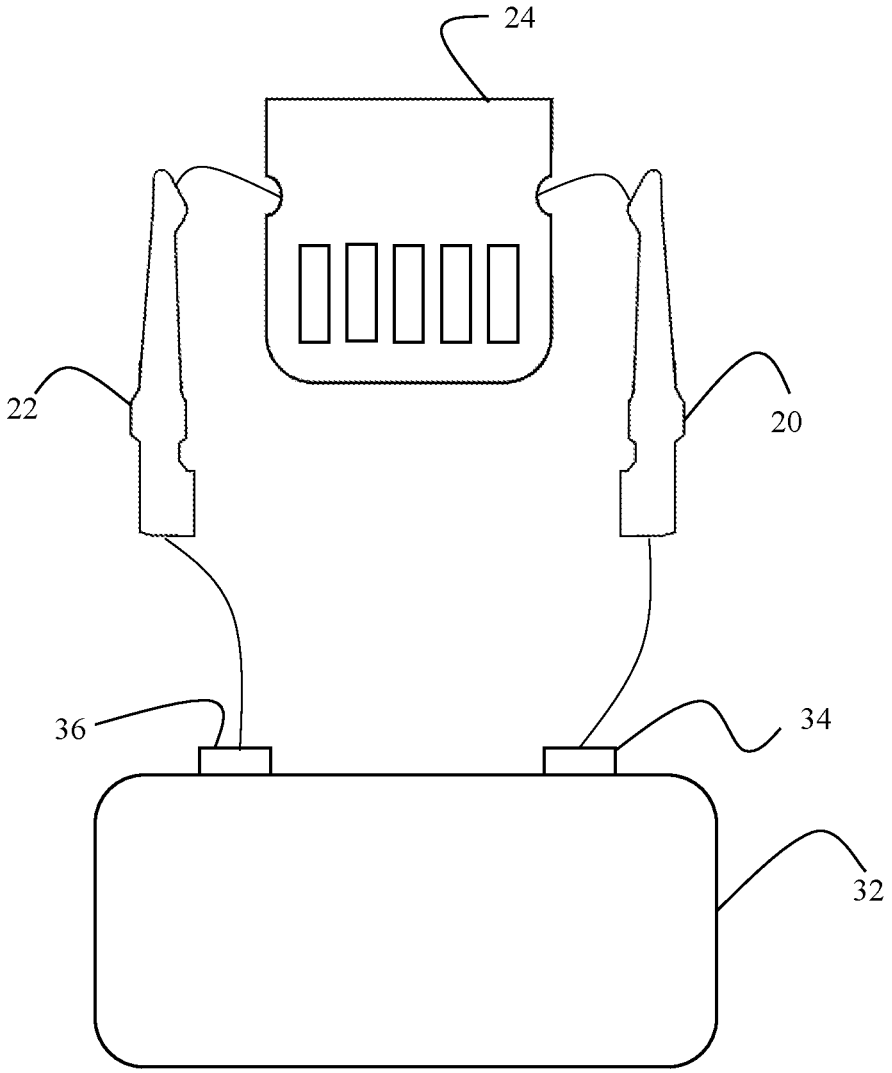
FIG. 3 is a schematic diagram depicting a closed electric circuit being monitored by an alarm module, the electric circuit formed between the latches of the male plug and the mid-plate of the female receptacle.

FIG. 3 schematically illustrates the circuit being monitored by alarm module 32 in the embodiment disclosed above. The electric circuit is as follows: 1) current flows from first terminal 34 to first latch 20; 2) from first latch 20 to mid-plate 24; 3) from mid-plate 24 to second latch 22; and 4) from second latch 22 to second terminal 36 of alarm module 32, thereby closing an electric circuit. The circuit remains closed while plug 14 remains within receptacle 12. When plug 14 is removed from receptacle 12, the contacts between first latch 20 and mid-plate 24 and second latch 22 and mid-plate 24 terminate. This event breaks the electron flow between first and second terminal 36 of alarm module 32, thereby triggering an alarm.

Figure 4:
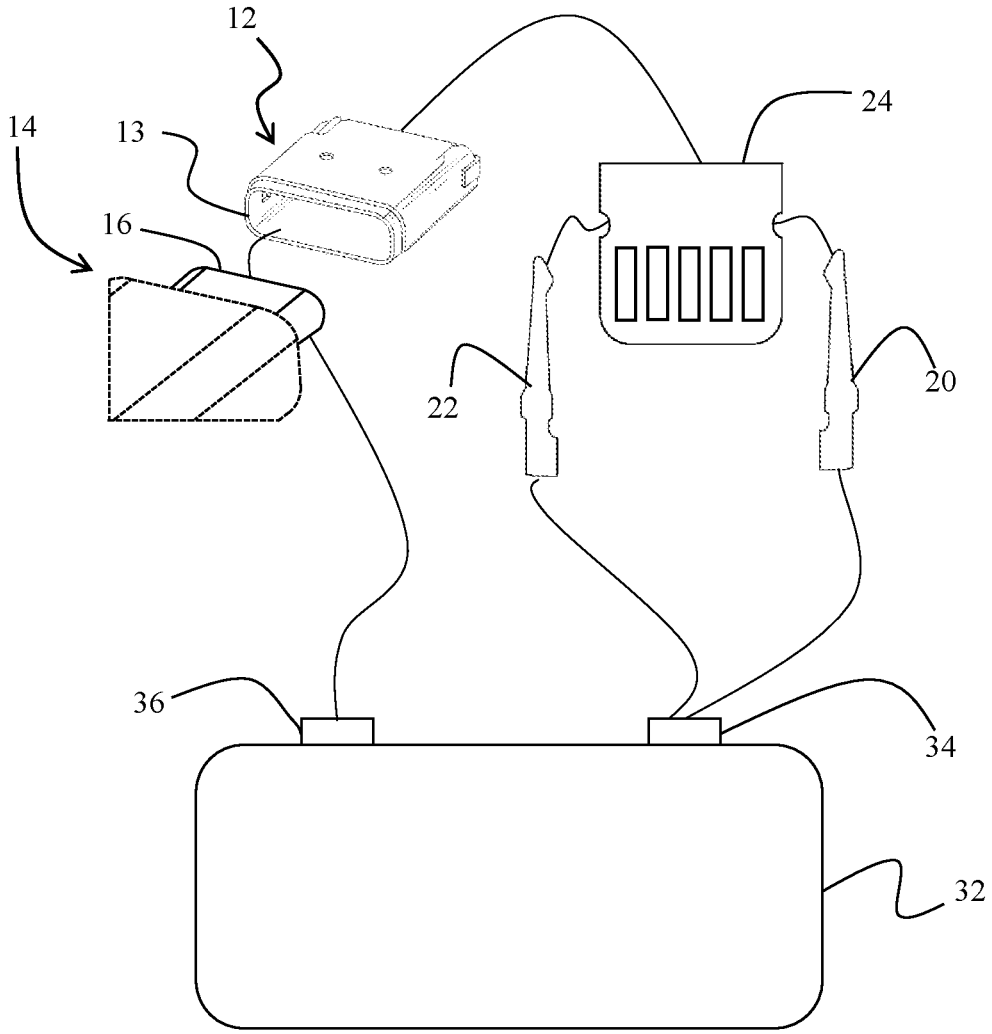
FIG. 4 is a schematic diagram depicting a closed electric circuit being monitored by an alarm module, the electric circuit formed between the latches of the male plug, the mid-plate, the shell of the female receptacle, and the sheath of the male plug.

In an alternative embodiment schematically illustrated in FIG. 4, both first and second latches 20 and 22 are in electrical communication with first terminal 34 of alarm module 32. Sheath 16 of plug 14 is in electrical communication with second terminal 36 of alarm module 32. In a Type C USB connector, mid-plate 24 and shell 13 of receptacle 12 are both grounded and are in electrical communication with one another. In this embodiment, the electric current flows from first terminal 34 to second terminal 36 of alarm module 32 as follows: 1) from first terminal 34 to first and second latches 20 and 22; 2) from first and second latches 20 and 22 to mid-plate 24; 3) from mid-plate 24 to shell 13 of receptacle 12; 4) from shell 13 of receptacle 12 to sheath 16 of plug 14, wherein the exterior surface of sheath 16 contacts the interior surface of shell 13; and 5) from sheath 16 of plug 14 to second terminal 36 of alarm module 32, thereby creating a closed circuit. In this embodiment, alarm module 32 monitors both the connection between first and second latches 20, 22 and mid-plate 24 and the connection between sheath 16 and shell 13. Disturbances in either one of these connections will trigger an alarm. Since both latches are conductive, a certain amount of movement of plug 14 within receptacle 12 is permissible without triggering an alarm because even if one of latches 20 or 22 breaks connection with mid-plate 24, the alarm will not be triggered so long as at least one of latches 20 or 22 maintains the connection with mid-plate 24. Therefore, this embodiment provides a benefit of reducing the instances of false alarms.

Figure 5:
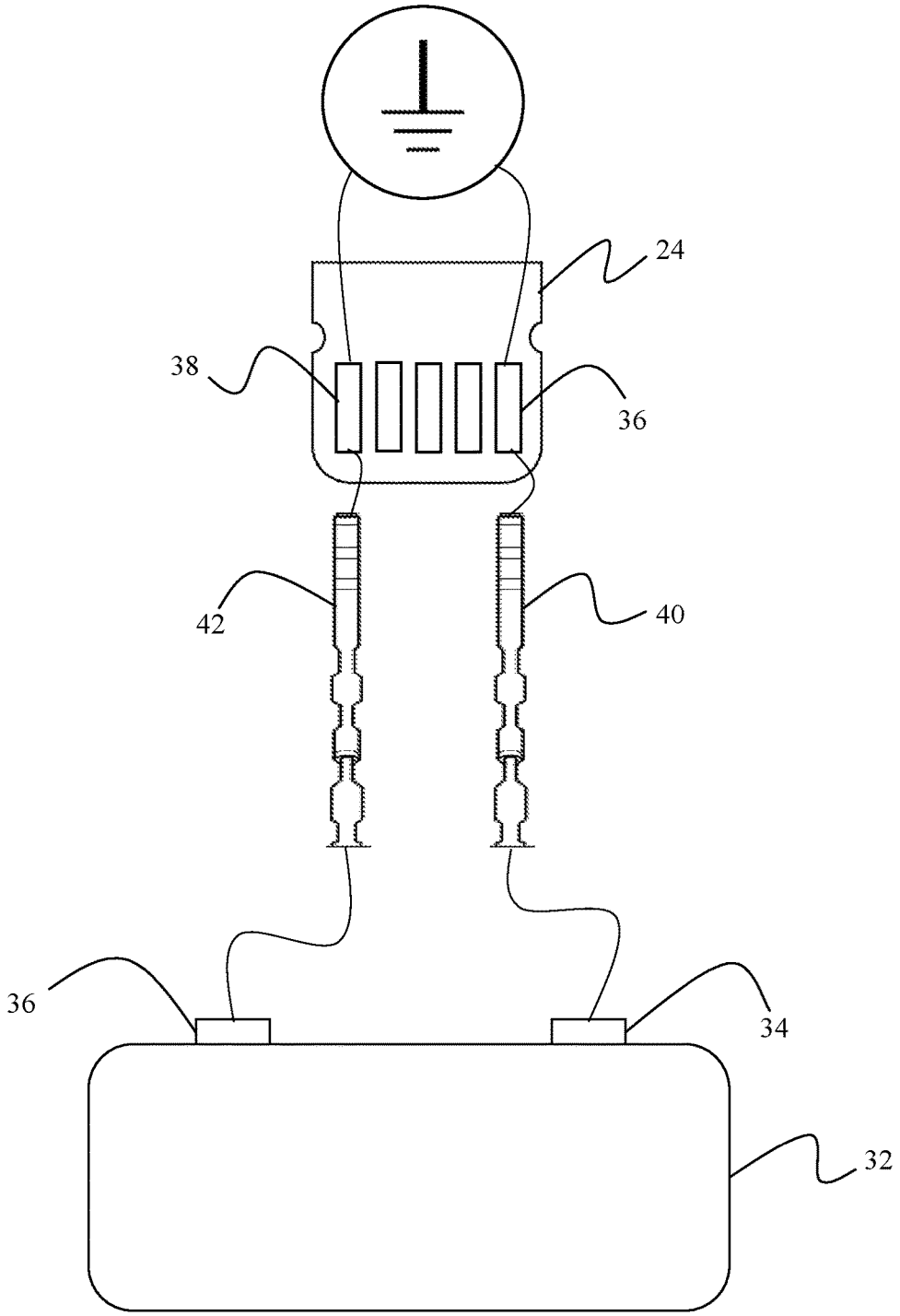
FIG. 5 is a schematic diagram depicting a closed electric circuit being monitored by an alarm module, the electric circuit formed between the first conductive pin of the male plug, the first and second ground contacts of the female receptacle, and the second conductive pin of the male plug.

FIG. 5 schematically illustrates another embodiment of anti-theft device 10 in which first and second latches 20 and 22 may be eliminated. Mid-plate 24 of receptacle 12 contains a plurality of electric contacts. Two of the plurality of electric contacts—a first ground contact 36 and a second ground contact 38—are used for grounding an electric circuit connected to receptacle 12, thus enabling an electric current to flow between first and second ground contacts 36 and 38. Plug 14 of the anti-theft device 10 has a first conductive pin 40 and a second conductive pin 42. When plug 14 is inserted into receptacle 12, first and second pins 40 and 42 within plug 14 engage first and second ground contacts 36 and 38 respectively. In this embodiment, first pin 40 of plug 14 is in electrical communication with first terminal 34 of alarm module 32, and second pin 42 of plug 14 is in electrical communication with second terminal 36 of alarm module 32. Accordingly, when plug 14 is within receptacle 12, a closed circuit is formed between first and second terminals 34 and 36 of alarm module 32. The following is a summary of the electricity flow within the circuit: 1) an electric current flows from first terminal 34 to first pin 40 of plug 14; 2) from first pin 40 to first ground contact 36 of receptacle 12; 3) from first ground contact 36 to second ground contact 38; 4) from second ground contact 38 of receptacle 12 to second pin 42 of plug 14; and 5) from second pin 42 of plug 14 to second terminal 36 of alarm module 32. Alarm module 32 monitors the electron flow between first and second terminals 34 and 36 and transmits an alarm signal in response to detecting a disturbance in the electron flow. Accordingly, removal of plug 14 from receptacle 12 will break the connection between first and second pins 40 and 42 of plug 14 and the first and second ground contacts 36 and 38 of receptacle 12, thereby triggering an alarm.

Figure 6:
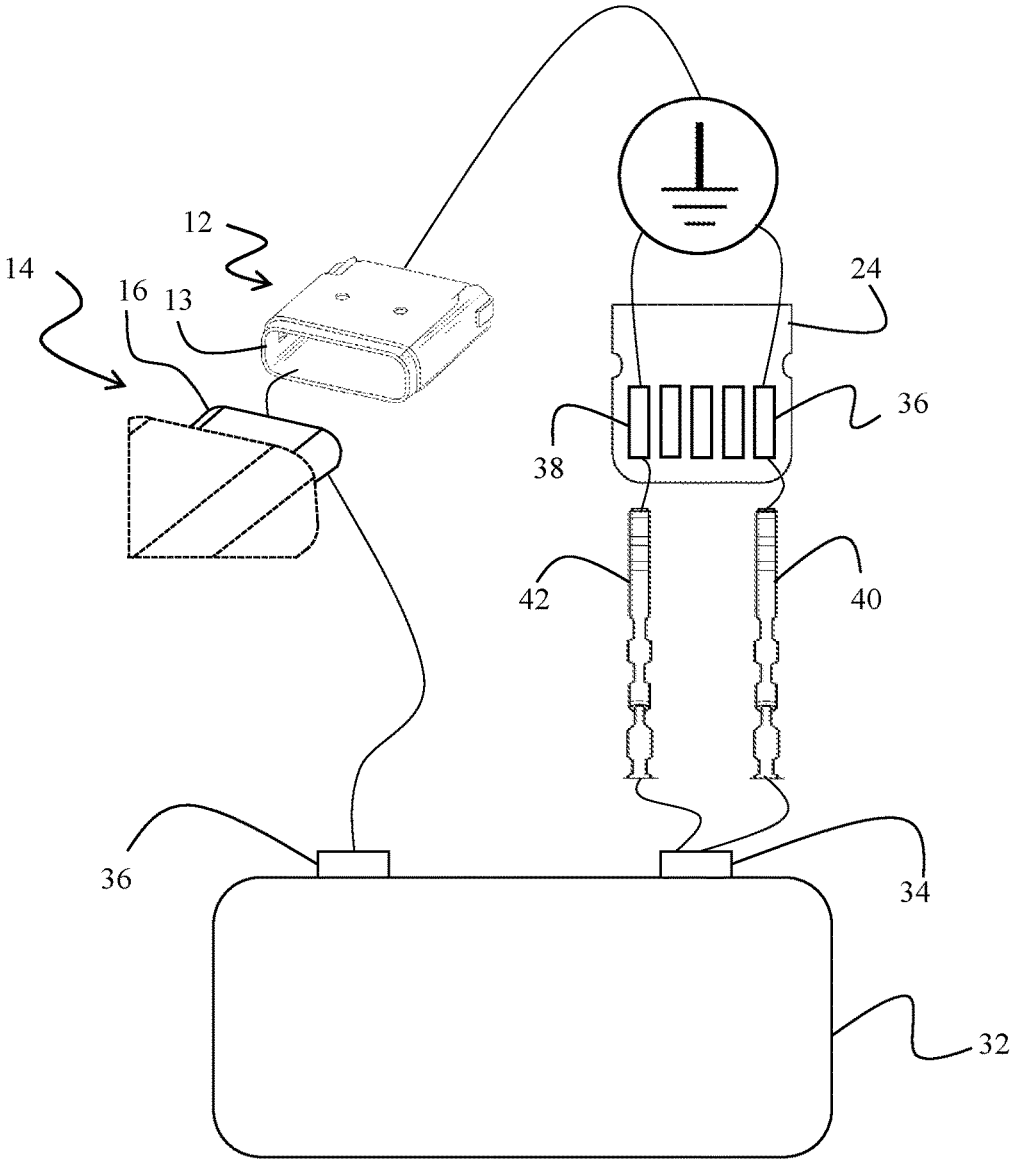
FIG. 6 is a schematic diagram depicting a closed electric circuit being monitored by an alarm module, the electric circuit formed between the conductive pins of the male plug, the ground contacts and the shell of the female receptacle, and the sheath of the male plug.

FIG. 6 schematically illustrates yet another embodiment of anti-theft device 10. The following circuit is created by plug 14 and receptacle 12 and is monitored by alarm module 32. Both first and second pins 40 and 42 of plug 14 are electrically connected to first terminal 34 of alarm module 32. Shell 13 of receptacle 12 is used for grounding the circuitry connected to receptacle 12 and, therefore, is in electrical communication with both first and second ground contacts 36 and 38. In this embodiment, sheath 16 of plug 14 is in electrical communication with second terminal 36 of alarm module 32. Because the outer surface of sheath 16 contacts the inner surface of shell 13, electric current can flow between these two components. The following circuit is created between first and second terminal 34 and 36 of alarm module 32: 1) electric current flows from first terminal 34 of alarm module 32 to first and second pins 40 and 42 of plug 14; 2) from first and second pins 40 and 42 of plug 14 to the first and second ground contacts 36 and 38 of receptacle 12; 3) from first and second ground contacts 36 and 38 to shell 13 of receptacle 12; 4) from shell 13 to sheath 16 of plug 14; and 5) from sheath 16 to second terminal 36 of alarm module 32. Alarm module 32 monitors the electron flow between first and second terminals 34 and 36 and transmits an alarm signal in response to detecting a disturbance in the electron flow.

In this embodiment, it is only necessary that either the first pin 40 or second pin 42 engages the corresponding ground contact 36 or 38 at any given time. This configuration reduces occurrences of false alarms by permitting some movement of plug 14 within receptacle 12 without interrupting the electron flow between first and second terminal 34 and 36 of alarm module 32. In a variation of this embodiment, plug 14 may have only a single contact—either first pin 40 or second pin 42—connected to first terminal 34 as this will be sufficient to close the circuit between first and second terminals 34 and 36 of alarm module 32.

Anti-theft device 10 is unobtrusive and allows the customers to fully interact with the electronic gadget being displayed. Furthermore, anti-theft device 10 may be used in conjunction with other anti-theft measures, including various brackets and security sensors attached to the gadget. Anti-theft device 10 may supply electric current to the gadget through the USB connection to power the gadget, thereby allowing for continuous demonstrations without a need to recharge.

Glossary of Claim Terms

Alarm module—a component of the anti-theft device configured to monitor the flow of an electric current between its first and second terminals when the male plug is inserted into the female receptacle. The alarm module is configured to transmit an alarm signal in response to detecting an interruption in the electron flow between the first and second terminals.

Pin—an electrically conductive member disposed within the sheath of the male plug configured to engage a corresponding electric contact of the female receptacle to establish an electrical communication therewith.

Female receptacle—a port generally residing within an electronic gadget configured to accept a corresponding male plug. Female receptacle generally comprises a shell and a plurality of electric contacts disposed within the shell. The female receptacle is used for transferring data to and from the electronic gadget, supplying electric current to the electronic gadget, and allowing the electronic gadget to communicate with other electronic devices.

Latch—an elongated electrically-conductive member disposed within the sheath of the male plug. The latch is configured to contact a lateral edge of a mid-plate disposed within the shell of the female receptacle.

Ground contact—an electric contact disposed within the shell of the female receptacle configured to engage a corresponding conductive pin of the male plug to establish an electrical communication therewith, wherein the electrical communication is grounded.

Male plug—a component intended for insertion into a corresponding female receptacle. The male plug comprises a sheath and a plurality of conductive pins disposed within the sheath. The male plug is configured for insertion into the female receptacle. In the inserted configuration, the conductive pins of the male plug are in electrical communication with the electric contacts of the female receptacle, and the sheath of the male plugs is in electrical communication with the shell of the female receptacle.

Mid-plate—a conductive component generally disposed in the center of the shell of the female receptacle used to support the electric contacts residing within the shell.

Sheath—a metal casing of the male plug partially enclosing the conductive pins disposed therein. The sheath is configured for insertion into the shell of the female port, wherein the sheath and the shell establish electrical communication with one another when the male port resides within the female receptacle.

Shell—a metal casing of the female receptacle partially enclosing the electric contacts. The shell is configured to receive the sheath of the male plug making an electrical contact therewith.

Terminal (of an alarm module)—an electrically-conductive member of an alarm module in electrical communication with the circuitry disposed therein. The alarm module monitors the flow of electric current between the first terminal and the second terminal and transmits an alarm signal in response to interruption in the electron flow between the two terminals.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. An anti-theft device for monitoring an electronic device having a female receptacle, the female receptacle having a shell and a first ground contact in electrical communication with the shell, the anti-theft device comprising:

an alarm module configured to monitor a flow of electric current within a closed electric circuit and transmitting an alarm signal responsive to an interruption in the flow of the electric current;

a male plug having an electrically-conductive sheath in electrical communication with the alarm module, the sheath being configured for insertion into the shell of the female receptacle, wherein the sheath and the shell are in electrical communication with one another when the sheath is inserted into the shell;

a first conductive ground pin disposed within the sheath of the male plug, the first conductive ground pin being in electrical communication with the alarm module and being electrically insulated from the sheath, wherein the first conductive ground pin is configured to engage the first ground contact of the female receptacle when the sheath of the male plug is inserted into the shell of the female receptacle;

whereby, when the male plug resides within the female receptacle, the first conductive ground pin and the sheath being in electrical communication with one another with electric current flowing between the first conductive ground pin, the first ground contact, the shell of the female receptacle, and the sheath of the male plug, thereby creating the closed electric circuit;

wherein the alarm module supplies electric current to the first conductive ground pin or the sheath of the male plug and monitors the flow of the electric current between the first conductive ground pin and the sheath, the alarm module being configured to transmit an alarm signal responsive to detecting an interruption in the flow of the electric current.

2. An anti-theft device according to claim 1, further comprising:

a second conductive pin disposed within the sheath of the male plug, the second conductive pin being in electrical communication with the alarm module and being electrically insulated from the sheath;

wherein the second conductive pin is configured to engage a second ground contact within the female receptacle, the second ground contact being in electrical communication with the shell of the female receptacle, thereby enabling electric current flow between the second conductive pin and the shell of the male plug.

3. The anti-theft device according to claim 1, wherein the first ground contact resides on a mid-plate disposed within the shell of the female receptacle.

4. The anti-theft device according to claim 1, further comprising a plurality of contacts residing within the shell, wherein the first ground contact occupies either an outmost left or an outmost right position within the plurality of contacts.

5. The anti-theft device according to claim 1, further comprising additional conductive pins disposed within the shell of the male plug, the additional conductive pins configured to engage corresponding contacts within the female receptacle of a gadget, thereby supplying electric current to the gadget to power the gadget.

6. The anti-theft device according to claim 1, wherein the male plug is a USB Type C male connector.

7. The anti-theft device according to claim 1, wherein the female plug is a USB Type C female connector.

8. The anti-theft device according to claim 1, wherein the alarm signal triggers an alarm selected from the group consisting of an audible alarm, a visual alarm, and a communication to a designated party via a phone call, a text message, or an email.

* * * * *